US007704900B2

(12) United States Patent
Yoshimoto et al.

(10) Patent No.: US 7,704,900 B2
(45) Date of Patent: Apr. 27, 2010

(54) ARTIFICIAL LEATHER SHEETS AND METHOD FOR PRODUCING THEM

(75) Inventors: Shinichi Yoshimoto, Okayama (JP); Tetsuya Ashida, Okayama (JP); Hisao Yoneda, Okayama (JP)

(73) Assignee: Kuraray Co., Ltd., Kurashiki (JP)

( * ) Notice: Subject to any disclaimer, the term of this patent is extended or adjusted under 35 U.S.C. 154(b) by 219 days.

(21) Appl. No.: 10/928,251

(22) Filed: Aug. 30, 2004

(65) Prior Publication Data

US 2005/0084719 A1 Apr. 21, 2005

(30) Foreign Application Priority Data

Aug. 28, 2003 (JP) ..... 304531/2003

(51) Int. Cl.
*D04H 1/54* (2006.01)
*B32B 5/18* (2006.01)
*B32B 27/02* (2006.01)

(52) U.S. Cl. ..... 442/361; 442/328; 442/363; 442/415; 428/904; 264/211.16; 264/211.19

(58) Field of Classification Search ..... 428/904; 442/339

See application file for complete search history.

(56) References Cited

U.S. PATENT DOCUMENTS 4,476,186 A * 10/1984 Kato et al. ..... 442/60
4,515,854 A 5/1985 Kogame et al.
4,833,012 A * 5/1989 Makimura et al. ..... 442/329
5,503,899 A 4/1996 Ashida et al.
5,876,466 A 3/1999 Nakashima et al.
6,159,581 A 12/2000 Yoneda et al.
6,322,851 B1 11/2001 Adachi et al.
6,442,992 B2 9/2002 Tsubouchi et al.
6,451,404 B1 9/2002 Nobuto et al.
6,479,153 B1 11/2002 Kato et al.
6,517,938 B1 2/2003 Andoh et al.
6,767,853 B1 * 7/2004 Nakayama et al. ..... 442/361
2004/0157037 A1 * 8/2004 Yamaguchi et al. ..... 428/91

FOREIGN PATENT DOCUMENTS

EP 0 855 461 A1 7/1998

OTHER PUBLICATIONS

English Machine Translation of JP 2001-020183.*
Patent Abstracts of Japan, JP 6-220774, Aug. 9, 1994.
Patent Abstracts of Japan, JP 10-060782, Mar. 3, 1998.
Database WPI, AN 1985-200404, XP-002307902, JP 60-126359, Jul. 5, 1985.

* cited by examiner

*Primary Examiner*—Jennifer A Chriss
(74) *Attorney, Agent, or Firm*—Oblon, Spivak, McClelland, Maier & Neustadt, L.L.P.

(57) ABSTRACT

Provided is an artificial leather sheet that comprises microfine fibers of an inelastic polymer having a mean fiber diameter of at most 5 μm and an elastic polymer, in which the major portion of the elastic polymer forms a fibrous structure of the entangled nonwoven fabric with the microfine fibers of inelastic polymer throughout the entire layer of the artificial leather sheet in the thickness direction thereof, and a part of the elastic polymer forms a porous layer integrated with the entangled nonwoven fabric structure on at least one face of the artificial leather sheet. The artificial leather sheet does not substantially undergo structure deformation even when repeatedly elongated and deformed. It has good elastic stretchability, and has a soft and dense feel, and its appearance is good not detracting from the drapability of the sheet.

20 Claims, 1 Drawing Sheet

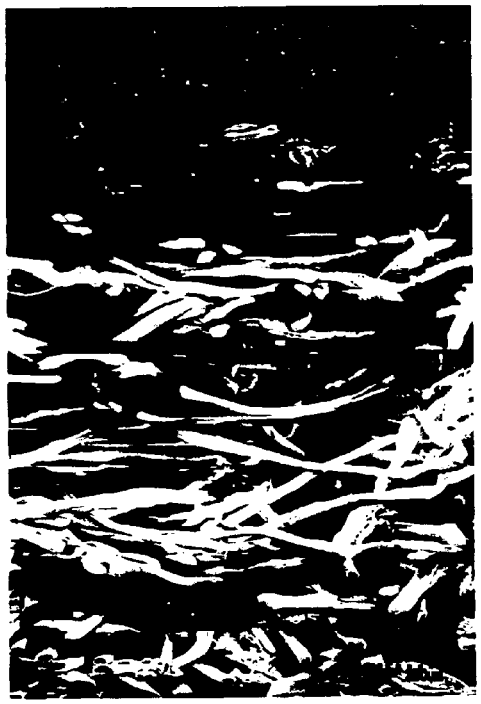
【fig1】
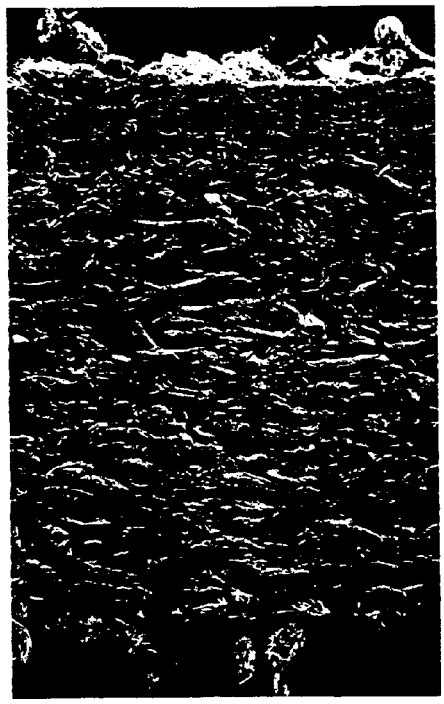
【fig2】

ARTIFICIAL LEATHER SHEETS AND METHOD FOR PRODUCING THEM

BACKGROUND OF THE INVENTION

1. Field of the Invention

The present invention relates to artificial leather sheets of good elastic stretchability. More precisely, the invention relates to artificial leather sheets that do not undergo substantial structure deformation even when repeatedly elongated and deformed. That is, the invention relates to artificial leather sheets that have good elastic stretchability, shape retainability, shape stability and shape recoverability, while having a soft and dense feel. Additionally, an aspect of the present invention relates to napped artificial leather sheets produced by napping at least one face of the artificial leather sheets, while having good uniformity in the napped condition thereof and which have a good feel and have good elastic stretchability and drapability. Furthermore, an additional aspect of the present invention pertains to grained artificial leather sheets produced by forming a coating layer on at least one face of the artificial leather sheets; whereby said grained artificial leather sheets have a good feel and have good elastic stretchability and drapability and in which the coating layer has good surface smoothness and peeling strength even though it is extremely thin. An additional aspect of the present invention also relates to a method for producing those types of artificial leather sheets.

2. Description of the Background

Napped sheets produced by napping at least one face of fibrous textiles such as woven fabrics, knitted fabrics and nonwoven fabrics or at least one face of fibrous substrates having a foamed structure of elastic polymer therein have appearance, texture, feeling and handling that are expressed by the length, density and other properties of raised fibers, which simulate those characteristics of natural suede or nubuck leathers. Therefore, such napped sheets are now mass-produced as napped sheets with suede- or nubuck-finish.

Additionally, napped artificial leathers with suede- or nubuck-finish, which are produced by raising a nap of microfine fibers on the surface of a fibrous structure comprising an entangled nonwoven fabric of microfine fiber bundles and an elastic polymer impregnated thereinto, are known as textile materials being comparable to natural leathers in their structures and having qualities equal to or higher than those of natural leathers. Thus, it is noted that these napped artificial leathers possess excellent properties such as elegant napped surface, soft touch, dense feel, excellent drapability irrespective of its light weight, and unlike woven or knitted fabrics, there is a diminished occurrence of surface unraveling when cut.

There has been a continuous demand for further improving the quality of napped artificial leather sheets to provide high-quality products which are satisfactory in every quality relating to aesthetic sense, feeling, handling, and clothing comfort such as suede appearance, nubuck appearance, soft touch, excellent feel and excellent drapability.

For example, JP-B-01-41742 describes stretchable napped artificial leather sheets with excellent feel, which is prepared from a stretchable entangled nonwoven fabric via a process which entails shrinking an entangled nonwoven fabric comprising elastic polymer fibers (elastic fibers) and inelastic polymer fibers (inelastic fibers) in an areal ratio of 10 to 80%. The proposed artificial leather made of the elastic fibers and inelastic fibers is excellent in drapability. This is, in part, due to the flexibility thereof, which is, in turn, attributable to the elastic fibers all remaining in a free fibrous form therein. However, the proposed artificial leather made of the elastic fibers and inelastic fibers suffers immeasurably during the napping process, for example, by buffing or the like, because of poor binding ability of the inelastic fibers. Consequently, the proposed artificial leather made of the elastic fibers and inelastic fibers, when napped, is rough in appearance, and deviates from the desired suede or nubuck appearance.

JP-B-03-16427 describes artificial leather with good mechanical properties, which is made of multi-component fibers capable of forming two or more kinds of elastic fibers having different melting points and fibers capable of forming microfine inelastic fibers. However, this artificial leather is problematic in that its low-melting elastic fiber constituents provide only a small binder effect, which results in an artificial leather that is unable of attaining an excellent suede-look.

JP-B-05-65627 describes artificial leather with good appearance, which is produced by impregnating polyurethane into a nonwoven fabric made only of sea-island fibers capable of forming inelastic microfine fibers, removing the sea component by solvent extraction to form the inelastic microfine fibers, and then dyeing. However, since the nonwoven fabric does not include elastic fibers, the artificial leather loses its original structure after repeated extensional deformations. Additionally, the artificial leather is not soft to the touch, is rough feeling, and has poor drapability, which is, in part, due to the fact that polyurethane resin impregnated into the nonwoven fabric forms a foamed sheet structure.

JP-B-01-41742 and JP-B-03-16427 describe methods that produce stretchable artificial leathers, but do not produce artificial leathers capable of having a napped surface of raised fibers with good appearance. Alternatively, the method described in JP-B-05-65627 provides for artificial leather that has good appearance, but experiences poor stretchability, feel, and drapability.

Accordingly, it is an object of the present invention to overcome the shortcomings of the previously described products and procedures, in order to provide an artificial leather sheet, whose elastic stretchability, feel, and drapability characteristics are excellent; a method of making the same; and a napped artificial leather sheet and a grained artificial leather sheet that are excellent in appearance.

As a result of extensive studies to attain the object as above the inventors have found the method mentioned below and have reached the present invention.

SUMMARY OF THE INVENTION

Accordingly, it is an object of the present invention to provide an artificial leather sheet, comprising: microfine fibers of an inelastic polymer having a mean fiber diameter of at most 5 μm; and an elastic polymer; wherein a major portion of the elastic polymer forms a fibrous structure of entangled nonwoven fabric with the microfine fibers of inelastic polymer throughout the entire layer of the artificial leather sheet in the thickness direction thereof; and wherein a part of the elastic polymer forms a porous layer integrated with the entangled nonwoven fabric structure in at least one face of the artificial leather sheet.

It is another object of the present invention to provide a process for producing artificial leather sheets, which comprises sequentially: preparing an entangled nonwoven fabric that comprises fibers (A) having a part of fibers of an elastic polymer in at least their surface and capable of forming fibers of an elastic polymer and fibers (B) capable of forming microfine fibers of an inelastic polymer having a mean fiber diameter of at most 5 μm, applying a liquid that contains at least a good solvent for the elastic polymer, to at least one face of the entangled nonwoven fabric to thereby partly dissolve the elastic polymer in the fibers (A) existing in at least the surface layer part thereof, and then applying thereto a poor solvent for the elastic polymer, and forming fibers of elastic polymer and microfine fibers of inelastic polymer having a mean fiber diameter of at most 5 μm, from the fibers (A) and the fibers (B), respectively.

Moreover, it is another object of the present invention to provide napped artificial leather sheets and grained artificial leather sheets that are excellent in appearance.

These and other object of the claimed invention are made possible by an artificial leather sheet, comprising microfine fibers of an inelastic polymer having a mean fiber diameter of at most 5 μm; and an elastic polymer; wherein a major portion of the elastic polymer forms a fibrous structure of entangled nonwoven fabric with the microfine fibers of inelastic polymer throughout the entire layer of the artificial leather sheet in the thickness direction thereof; and wherein a part of the elastic polymer forms a porous layer integrated with the entangled nonwoven fabric structure in at least one face of the artificial leather sheet.

DETAILED DESCRIPTION OF THE INVENTION

Specifically, the invention is directed to an artificial leather sheet, comprising microfine fibers of an inelastic polymer having a mean fiber diameter of at most 5 μm; and an elastic polymer; wherein a major portion of the elastic polymer forms a fibrous structure of entangled nonwoven fabric with the microfine fibers of inelastic polymer throughout the entire layer of the artificial leather sheet in the thickness direction thereof; and wherein a part of the elastic polymer forms a porous layer integrated with the entangled nonwoven fabric structure in at least one face of the artificial leather sheet.

Preferably, the fibrous elastic polymer forms a partly porous structure. Also preferably, the microfine fibers of inelastic polymer and the fibers of elastic polymer are partly bonded to each other.

The invention also provides a napped artificial leather sheet that comprises a nap comprising microfine fibers of an inelastic polymer, on at least the face of the artificial leather sheet with a porous layer formed thereon. The invention further provides a grained artificial leather sheet that has a coating layer on at least the face of the artificial leather sheet with a porous layer formed thereon.

The invention still further provides a method for producing artificial leather sheets that comprises sequentially preparing an entangled nonwoven fabric that comprises fibers (A) having a part of fibers of an elastic polymer in at least their surface and capable of forming fibers of the elastic polymer and fibers (B) capable of forming microfine fibers of an inelastic polymer having a mean fiber diameter of at most 5 μm; applying a liquid that contains at least a good solvent for the elastic polymer, to at least one face of the entangled nonwoven fabric to thereby partly dissolve the elastic polymer in the fibers (A) existing in at least the surface layer part thereof, and then applying thereto a poor solvent for the elastic polymer; and forming fibers of elastic polymer and microfine fibers of inelastic polymer having a mean fiber diameter of at most 5 μm, from the fibers (A) and the fibers (B), respectively.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein:

FIG. 1 is an electronic micrograph showing one example of a cross-section profile of the artificial leather sheet of the invention from which only the inelastic polymer fibers have been removed, represented herein in place of a drawing thereof.

FIG. 2 is an electronic micrograph showing one example of a cross-section profile of the artificial leather sheet of the invention, represented herein in place of a drawing thereof.

DETAILED DESCRIPTION OF THE PREFERRED EMBODIMENTS

The elastic polymer fibers (herein after referred to a elastic fibers) may be prepared by melt-spinning an elastic polymer alone, or by splitting multi-component fibers formed by melt-spinning a combination of an elastic polymer and at least one spinnable polymer having different chemical or physical properties from those of the elastic polymer, or by extracting and removing at least one additional polymer from the multi-component fibers. The multi-component fibers have an elastic fibers-forming component in at least a part of their surface, and can form elastic fibers through splitting, extraction or the like treatment (hereinafter simply referred to as fibers (A)). The fibers (A) are not specifically defined in their structure as long as they are multi-component fibers having an elastic polymer in at least a part of their surface, but are preferably sea-island fibers and splittable fibers. Above all, sea-island fibers are more preferred; and sea-island mix-spun fibers are even more preferred because an elastic polymer as an island component is allowed to be randomly present in at least a part of their surface. The areal proportion of the surface of the fibers (A) occupied by an elastic polymer is preferably from 0.1 to 95%, but also including all values, any ranges, or sub-ranges in between including 5, 10, 15, 20, 25, 30, 35, 40, 45, 55, 60, 65, 70, 75, 80, 85, and 90%; more preferably from 1 to 70%, but also including all values, any ranges, or sub-ranges in between including 5, 10, 15, 20, 25, 30, 35, 40, 45, 55, 60, and 65%. When the proportion is 0.1% or more, the elastic fibers are readily made to have a partially porous structure, and may be readily bonded to each other. When it is 95% or less, the deterioration of the process passing properties such as card passing properties attributable to the properties of elastic polymer can be avoided.

Examples of the elastic polymer include polyurethanes that are produced through reaction of at least one polyol selected from polymer polyols having a number-average molecular weight of from 500 to 3500, but also including all values, any ranges, or sub-ranges in between including 1000, 1500, 2000, 2500, and 3000; such as polyester polyol, polyether polyol, polyester ether polyol, polylactone polyol and polycarbonate polyol, an aromatic, alicyclic or aliphatic organic polyisocyanate such as 4,4'-diphenylmethane diisocyanate, tolylene diisocyanate, isophorone diisocyanate, dicyclohexylmethane 4,4'-diisocyanate and hexamethylene diisocyanate, and a chain extender having two active hydrogen atoms such as 1,4-butanediol and ethylenediamine; polyester elastomers such as polyester elastomer and polyether ester elastomer; polyamide elastomers such as polyether ester amide elastomer and polyester amide elastomer; conjugated diene polymers such as polyisoprene and polybutadiene; block copolymers having blocks of conjugated diene polymer such as polyisoprene and polybutadiene; and melt-spinnable elastomers showing rubber elastic behavior. Of the above, polyurethanes are most preferred because of their good softness, low resilience, high abrasion resistance, easiness in bonding to inelastic microfine fibers, high heat resistance, excellent durability, etc.

The elastic polymer may comprise additives, for example, a pigment such as carbon black and a heat stability improver for the resin, whose identity and quantity does not detract from the effect of the invention.

The sea component polymer (polymer to be removed through extraction or decomposition) of the multi-component fibers (A) is required to be different from the island component polymer both in terms of solvent solubility and reactivity with respect to the decomposing agent. The sea component, for example, preferred is a polymer having solubility and decomposability higher than those of the island component polymer, having low compatibility or affinity to the island component polymer, and having melt viscosity or surface tension smaller than those of the island component polymer. Examples of the polymer are melt-spinnable polymers, e.g., easily soluble polymers such as polyethylene, polystyrene, modified polystyrene, and ethylene-propylene copolymer, and easily decomposable polymers such as polyethylene terephthalate modified (copolymerized) with sodium sulfoisophthalate or polyethylene glycol.

The microfine fibers of inelastic polymer (inelastic microfine fibers) are formed by splitting multi-component fibers comprising an inelastic polymer and at least one spinnable polymer different from the inelastic polymer in their chemical or physical properties, or by removing at least one additional polymer from the multi-component fibers through extraction.

The multi-component fibers can form inelastic microfine fibers having a mean fiber diameter of at most 5 μm through splitting, extraction or the like treatment (hereinafter simply referred to as fibers (B)). The microfine fibers from the fibers (B) must have a mean fiber diameter of at most 5 μm, but preferably at most 3 μm, more preferably at most 1.5 μm. If their mean fiber diameter exceeds 5 μm, then the artificial leather sheet experiences a reduction in its flexibility and density feeling. Additionally, if their mean fiber diameter exceeds 5 μm, then the napped artificial leather sheet may have an extremely rough feel on the whole and undergoes a diminishment in its high-quality feeling, for example, a diminishment in the natural artificial leather silky and soft touch. The lowermost limit of the mean fiber diameter of the microfine fibers from the fibers (B) are not specifically defined, but is preferably at least 0.01 μm in view of the colorability and the physical properties of the artificial leather sheet.

Not specifically defined, the fibers (B) may be any multi-component fibers capable of forming inelastic microfine fibers having a mean fiber diameter of at most 5 μm, but are preferably sea-island fibers or splittable fibers. The inelastic polymer content of the fibers (B) is preferably from 10 to 90% by mass, but also including all values, any ranges, or sub-ranges in between including 15, 20, 25, 30, 35, 40, 45, 55, 60, 65, 70, 75, 80, and 85% by mass; more preferably from 30 to 70% by mass, but also including all values, any ranges, or sub-ranges in between including 35, 40, 45, 55, 60, and 65% by mass.

Examples of the inelastic polymer include, but are not limited to, for example, melt-spinnable polyamides such as nylon-6, nylon-66, nylon-10, nylon-11, nylon-12, and their copolymers; melt-spinnable polyesters such as polyethylene terephthalate, polytrimethylene terephthalate, polybutylene terephthalate, and cation-dyeable modified polyethylene terephthalate; and melt-spinnable polyolefins such as polypropylene and its copolymers. One or two kinds or more of these polymers may be used herein separately or as combined.

When the fibers (B) are sea-island fibers, then the inelastic polymer to constitute the island component thereof must be formed into microfine fibers without undue bonding of the resultant inelastic microfine fibers. Accordingly, when the fibers (A) and the fibers (B) are both sea-island fibers, then the inelastic polymer is preferably selected at least so as not to allow the resulting inelastic microfine fibers to bond together in the solvent treatment for removing the sea component through extraction or the like. Specifically, polymers having a degree of swelling in solvent of at most 10% by mass in the treatment for sea component removal are preferred.

The inelastic polymer may comprise additives, for example, at least one pigment, for example, carbon black; and an additive capable of improving the heat stability of a resin, whose identity and amount does not detract from the effect of the invention.

The sea component polymer of the fibers (B) may be basically the same as that of the fibers (A), and the polymers mentioned hereinabove for the fibers (A) may be used also for the fibers (B). The sea components of the fibers (A) and the fibers (B) may be different polymers, but preferably the same in view of the efficiency in removing them.

From the viewpoint of melt-spinning stability, the inelastic polymer and the polymer to constitute the sea component of the fibers (A) and the fibers (B) are preferably selected so as to have a melting point suitable to the melt-spinnable temperature of the elastic polymer. For example, the melting point of the inelastic polymer and the sea component polymers is preferably about 230° C. or lower when the elastic polymer is polyurethane; and is preferably about 260° C. or lower when the elastic polymer is polyester elastomer or polyamide elastomer.

The fibers (A) and the fibers (B) may be produced in any known spinning method and may be formed into nonwoven fabrics in any known method. For example, the fibers (A) and the fibers (B) are drawn, crimpled, cut and provided with oil, then mixed in a desired ratio, carded and made into webs through a webber. The mixing ratio of the fibers (A) and the fibers (B) is preferably so defined that the ratio of elastic polymer/inelastic polymer could fall between 20/80 and 80/20 by mass, but also including all values, any ranges, or sub-ranges in between including 30/70, 40/60, 50/50, 60/40, and 70/30; for better elastic stretchability and better feel of the artificial leather sheet and for better napping of the napped artificial leather sheet. When the proportion of the elastic polymer is 20% by mass or more, then the elastic stretchability of the artificial leather sheet obtained is good; and when 80% by mass or less, then the napping treatment may be attained effectively and the artificial leather sheet is prevented from being poorly napped to have a rubber-like feel.

After laminated to have a desired weight and a desired thickness, the laminated webs are formed into a nonwoven fabric in some known method of needle-punching or water-jet treatment. Preferably, the entangled nonwoven fabric is shrunk through heat treatment at a temperature falling between 50 and 150° C., but also including all values, any ranges, or sub-ranges in between including 60, 70, 80, 90, 100, 110, 120, 130, and 140° C.; or through heat treatment with hot water at a temperature falling between 50 and 95° C., but also including all values, any ranges, or sub-ranges in between including 60, 70, 80, and 90° C.; for better elastic stretchability of the artificial leather sheet. The degree of shrinkage of the fabric may be determined depending on the type of the fibers, the ratio by mass of the elastic polymer to the inelastic polymer, the spinning condition and the drawing condition for the fibers (A) and the fibers (B). For better appearance and better elastic stretchability of the artificial leather sheet, for better structure sustainability thereof not undergoing substantial structure deformation even when repeatedly elongated and deformed, it is desirable that the degree of areal shrinkage of the entangled nonwoven fabric is from 5 to 50%, but also including all values, any ranges, or sub-ranges in between including 10, 15, 20, 25, 30, 35, 40, and 45%.

If desired, the entangled nonwoven fabric may be temporarily fixed with a resin removable through dissolution, such as typically a water-soluble sizing agent that includes polyvinyl alcohol resin, etc. For further improving the surface smoothness of the artificial leather sheet and for imparting better writing effect to the napped artificial leather sheet, the surface of the entangled nonwoven fabric may be heat-pressed in any known method.

The thickness of the entangled nonwoven fabric is not specifically defined, and may be determined in any desired manner depending on the use of the artificial leather sheet. When the fabric is single-layered, its thickness is preferably from 0.2 to 10 mm or so, but also including all values, any ranges, or sub-ranges in between including 1, 2, 3, 4, 5, 6, 7, 8, and 9 mm; more preferably from 0.4 to 5 mm or so, but also including all values, any ranges, or sub-ranges in between including 1, 2, 3, and 4 mm, and all values and ranges in between all these listed values.

The density of the fabric is preferably from 0.20 to 0.65 g/cm$^3$, but also including all values, any ranges, or sub-ranges in between including 0.25, 0.30, 0.35, 0.40, 0.45, 0.50, 0.55, and 0.60 g/cm$^3$; more preferably from 0.25 to 0.55 g/cm$^3$, but also including all values, any ranges, or sub-ranges in between including 0.30, 0.35, 0.40, 0.45, and 0.50 g/cm$^3$. When the density is at least 0.20 g/cm$^3$, then the napped feel and the mechanical properties of the fibers may be good. When the density is at most 0.65 g/cm$^3$, then the feel of the artificial leather sheet may be soft and good.

The entangled nonwoven fabric may comprises, in the inside, a known elastic polymer in the form of a solution not dissolving the elastic polymer that constitutes the fibers (A). This is for enhancing the shape sustainability of the fabric, but should not detract from the effect of the invention. In this case, the ratio by mass of the additional elastic polymer to the fibers that constitute the entangled nonwoven fabric is preferably from 0.1 to 10%, but also including all values, any ranges, or sub-ranges in between including 1, 2, 3, 4, 5, 6, 7, 8, and 9%; more preferably from 0.5 to 5%, but also including all values, any ranges, or sub-ranges in between including 1, 2, 3, and 4%, and all values and ranges in between all these listed values. When the additional elastic polymer is polyurethane, then it is preferably applied, to the fabric, in the form of an emulsion thereof.

Next, it is necessary that a liquid containing at least a good solvent for the elastic polymer of the fibers (A) is applied to at least one face of the entangled nonwoven fabric to thereby partly dissolve the elastic polymer in the fibers (A) existing at least in the surface layer part of the fabric, and then a liquid containing a poor solvent for the elastic polymer is applied thereto.

Specifically, the important feature of the process of the invention is as follows: A treating liquid A that comprises at least a good solvent for the elastic polymer of the fibers (A) is applied to at least one face of the entangled nonwoven fabric, and since a part of the elastic polymer is exposed out on the surface or the end surface of the fibers (A), the elastic polymer partly existing in the surface of the fibers (A) is partly dissolved, and thereafter a treating liquid B that contains a poor solvent for the elastic polymer is applied to solidify the dissolved elastic polymer thereby giving pores to form a porous layer. Preferably, the elastic polymer is partly bonded together.

Regarding the solvent for the elastic polymer, for example, when the elastic polymer is polyurethane, a good solvent is selected from the group consisting of N,N-dimethylformamide (DMF), dioxane, and at least one alcohol, and mixtures thereof—above all, DMF is preferred. The treating liquid A may be a combination of a good solvent and a poor solvent for elastic polymer, or may be an elastic polymer solution comprising an elastic polymer and a good solvent or may be a combination of a good solvent and a poor solvent for elastic polymer. Preferably, the elastic polymer of the elastic polymer solution is the same type as that of the fibers-constituting elastic polymer. For example, when the fibers-constituting elastic polymer is polyurethane, then it is desirable that the elastic polymer solution is a polyurethane solution for easiness in forming the porous layer.

The concentration of the elastic polymer is preferably from 1 to 30% by mass in terms of the solid content thereof, but also including all values, any ranges, or sub-ranges in between including 5, 10, 15, 20, and 25% by mass; more preferably from 1 to 10% by mass, but also including all values, any ranges, or sub-ranges in between including 2, 3, 4, 5, 6, 7, 8, and 9% by mass, in terms of the solid content thereof. When at most 30% by mass, the elastic polymer solution may be prevented from deeply penetrating into the entangled nonwoven fabric, though depending on the amount thereof applied to the fabric, and therefore, the elastic fibers and/or the inelastic microfine fibers are prevented from being fixed with the excessive elastic polymer to lose their free movability and, as a result, the drapability and the elastic stretchability of the artificial leather sheet obtained are prevented from being lowered.

The ratio by weight of the elastic polymer (a) existing in the artificial leather sheet owing to the application of the elastic polymer solution thereto, to the elastic polymer (b) existing as a fibrous and partly porous structure owing to the fibers (A) used in producing the entangled nonwoven fabric, (a)/(b) preferably falls from 0/100 to 30/100, but also including all values, any ranges, or sub-ranges in between including 5/100, 10/100, 15/100, 20/100, and 25/100; more preferably from 0.5/100 to 10/100, but also including all values, any ranges, or sub-ranges in between including 2/100, 4/100, 6/100, and 8/100. When the proportion of the elastic polymer (a) is at most 30, the elastic fibers and/or the inelastic microfine fibers are prevented from being fixed with the elastic polymer to lose their free movability and the drapability and the elastic stretchability of the artificial leather sheet obtained are thereby prevented from being lowered.

For example, when the treating liquid A comprises an elastic polymer, the thickness of the porous layer to be formed in the surface layer part of the nonwoven fabric owing to the application of the treating liquid A thereto is preferably at most 60% of the overall thickness of the artificial leather sheet, more preferably at most 40%. The thickness of the porous layer as referred to herein is, when the layer is formed on both faces of the fabric, the total thickness of the two layers on both faces thereof. When the thickness of the porous layer is at most 60%, the feel, the drapability and the elastic stretchability of the artificial leather sheet obtained are prevented from being lowered.

For example, when the treating liquid A contains an elastic polymer the elastic polymer is preferably a polyurethane produced through reaction of at least one polymer diol having a mean molecular weight of from 500 to 3000, but also including all values, any ranges, or sub-ranges in between including 1000, 1500, 2000, and 2500; and selected from polyester diol, polyether diol, polyether ester diol, polylactone polyol and polycarbonate diol, at least one polyisocyanate selected from aromatic, alicyclic and aliphatic organic polyisocyanates such as 4,4'-diphenylmethane diisocyanate, isophorone diisocyanate and hexamethylene diisocyanate, and at least one low-molecular compound having at least two active hydrogen atoms such as ethylene glycol and ethylenediamine, in a predetermined molar ratio. If desired, any other polymer such as synthetic rubber or polyester elastomer may be added to the polyurethane. Also if desired, additives such as colorant, solidification-controlling agent and antioxidant may be added to the elastic polymer-containing treating liquid A.

It is important that a liquid that contains a poor solvent for the elastic polymer (this is hereinafter referred to as treating liquid B) is applied to the entangled nonwoven fabric previously coated with the treating liquid A. The poor solvent for elastic polymer is, for example, when the elastic polymer is polyurethane, a non-solvent for polyurethane, such as water, which includes all types of water; for example, tap water, distilled water, and partially or totally deionized water. After the treating liquid A has been applied to at least one face of the entangled nonwoven fabric, the treating liquid B is applied thereto whereby the partly dissolved elastic polymer solidifies to give pores. When solidifying, it is desirable that the dissolved elastic polymer existing in different sites partly bonds to each other to give a porous layer where the fibers (A) are partly bonded together.

Also preferably, the proportion of the elastic fibers-forming component existing in the surface of the fibers (A) is increased in some known spinning method, or the amount of the treating liquid A to be infiltrated into the nonwoven fabric is increased, or the proportion of the good solvent for elastic polymer in the treating liquid A is increased, whereby the number of the bonding sites of the fibers (A) is controlled to give a porous layer partially having a network structure. Also preferably, the porous layer formed has a composite structure where the elastic polymer solution and the fibers-constituting elastic polymer are present in a mixed state after being solidified. Having the porous layer thus formed, therefore, the artificial leather sheet obtained does not substantially undergo structure deformation even when repeatedly elongated and deformed, and it has a good feel and good drapability.

The porous condition as referred to herein is meant to indicate a fine spongy condition that is formed when elastic polymer is solidified while wet. When the elastic fibers from the fibers (A) are partly porous, the artificial leather sheet obtained may have a good feel and good drapability.

For applying the treating liquid A that contains the good solvent for the elastic polymer constituting the fibers (A), to at least one face of the entangled nonwoven fabric, there are mentioned various known coating methods of, for example, knife coating, blade coating, lip coating, rod coating, reverse roll coating, gravure coating, kiss coating, spray coating, etc. Above all, preferred are methods of blade coating, lip coating, gravure coating and spray coating, as they enable application of the coating liquid to only the surface layer part of the entangled nonwoven fabric. In addition, another advantage of the methods is that a low-concentration and low-viscosity treating liquid may be uniformly and smoothly applied to the surface of the fibers (A).

When the treating liquid A is applied to at least one face of the entangled nonwoven fabric to thereby partly dissolve the elastic fibers-forming component exposed out on the surface or the end surface of the fibers (A), it is desirable that the treatment with the treating liquid A is effected at 10 to 60° C. for 30 seconds to 4 minutes in order to avoid any undue dissolution of the component. The treating liquid B is applied to the fabric immediately after the treatment or after removal of the excess treating liquid A. The treating liquid B may be impregnated according to the method mentioned above. Preferably, the treatment with the treating liquid B is effected at 25 to 50° C. for 10 to 30 minutes. Also preferably, the amount of the treating liquid B to be applied is at least 100 parts by mass relative to 100 parts by mass of all the elastic polymer in the entangled nonwoven fabric, in view of the solidification stability of the elastic fibers-forming component.

After the entangled nonwoven fabric is treated with the treating liquid A and the treating liquid B in the manner as above, this is dried and then elastic fibers and inelastic microfine fibers are formed from the fibers (A) and the fibers (B). When the fibers (A) and the fibers (B) are sea-island fibers, it is desirable that they are treated with a liquid capable of dissolving or decomposing the sea component, for example, by dipping them in a liquid. For example, when the sea component is polyethylene or polystyrene, then toluene may be used; and when the sea component is an alkali-decomposable polyester, an aqueous sodium hydroxide solution may be used. The amount of the liquid to be used for dissolution or decomposition is preferably at least 100 parts by weight relative to 100 parts by weight of all the sea component polymer. Also preferably, the treating temperature falls from 5 to 50° C., but also including all values, any ranges, or sub-ranges in between including 10, 20, 30, and 40° C.; and the treating time falls from 5 to 40 minutes, but also including all values, any ranges, or sub-ranges in between including 10, 20, and 30 minutes.

The treatment removes the sea component from the fibers (A) and the fibers (B). As a result, the fibers (A) are converted into partly porous elastic fibers. The resulting elastic fibers partly bond to each other to form a network structure. The fibers (A) existing at least in the surface layer part of the fabric form partly-porous fiber aggregates of elastic polymer, and the elastic polymer fibers partly bond to each other or to the elastic polymer from the treating liquid A, to form a porous layer integrated with the entangled nonwoven fabric in at least one surface layer part of the artificial leather sheet formed. Further, the fibers (B) are converted into inelastic microfine fibers or their fiber bundles. It may be desirable that, according to known spinning technologies, the sea component proportion in the fibers (A) and the fibers (B) is reduced or the island component is exposed to the surface of the fibers to thereby partly bond the elastic fibers and the inelastic microfine fibers to each other. Preferably, the mean monofilament fineness of the elastic fibers from the fibers (A) is from 0.01 to 2 dtex, but also including all values, any ranges, or sub-ranges in between including 0.2, 0.4, 0.6, 0.8, 1.0, 1.2, 1.4, 1.6, and 1.8 dtex; more preferably from 0.01 to 0.5 dtex, but also including all values, any ranges, or sub-ranges in between including 0. 1, 0.2, 0.3, and 0.4 dtex. The mean fiber diameter of the inelastic microfine fibers from the fibers (B) must be at most 5 μm, but preferably at most 3 μm, more preferably at most 1.5 μm. If the mean fiber diameter is over 5 μm, the flexibility and the dense feel are deteriorated, and, in addition, when a napped artificial leather sheet is formed, it gives an extremely rough appearance as a whole and is poor in the high-quality feeling such as a natural artificial leather smoothness and good feel. Though not specifically defined, the lowermost limit of the mean fiber diameter of the fibers (B) is preferably at least 0.01 μm in view of the colorability and the physical properties of the artificial leather sheet.

The "partly porous condition of elastic fibers" as referred to herein means as follows: The artificial leather sheet is processed to remove the inelastic microfine fibers through extraction or decomposition. After the treatment, when the surface of the artificial leather sheet or the surface-parallel sliced face thereof is observed with a scanning electron microscope, from 10 to 100% of the surface of the elastic fibers is porous.

The "bonding of elastic fibers" as referred to herein means that the elastic fibers bond to each other or to the elastic polymer from the treating liquid A through fusion of the elastic polymer. The degree of bonding of the elastic fibers may be evaluated with the density of the bonding sites thereof. Specifically, when the sheet sample is observed with a scanning electron microscope in the same manner as above, it is desirable that the density of the bonding sites is from 1 to 10/2 $mm^2$, but also including all values, any ranges, or sub-ranges in between including 4/2, 6/2, and 8/2 mm 2; more preferably from 2 to 8/2 $mm^2$, but also including all values, any ranges, or sub-ranges in between including 5/2, 6/2, and 7/2 $mm^2$. Falling within the range, the artificial leather sheet obtained does not substantially undergo structure deformation even when repeatedly elongated and deformed, and its elastic stretchability is excellent.

The "network structure" as referred to herein means that at least one other elastic fiber is two-dimensionally or three-dimensionally bonded to one elastic fiber and the at least one other elastic fiber is further bonded to or contacted with still other elastic fiber(s). The existing proportion of the network structure is evaluated with the existing density thereof. Concretely, when the sheet sample is observed with a scanning electron microscope in the same manner as above, it is desirable that the existing density of the network structure is from 1 to 50/5 $mm^2$, but also including all values, any ranges, or sub-ranges in between including 10/5, 15/5, 20/5, 25/5, 30/5, 35/5, 40/5, and 45/5 $mm^2$; more preferably from 2 to 40/5 $mm^2$, but also including all values, any ranges, or sub-ranges in between including 15/5, 20/5, 25/5, 30/5, and 35/5. Falling within the range, the artificial leather sheet obtained does not substantially undergo structure deformation even when repeatedly elongated and deformed, and its elastic stretchability is excellent.

Preferably, a method of increasing the proportion of the elastic polymer that constitutes the fibers (A) and a method of exposing the elastic polymer on the surface of the fibers according to some known spinning technologies are employed for facilitating the bonding of the elastic polymer fibers to the inelastic polymer fibers, so that a structure in which the inelastic polymer microfine fibers are partly bonded to the elastic polymer fibers is provided.

The fibers (B) are converted into inelastic microfine fibers or their fiber bundles. It is also desirable that the sea component proportion in the fibers (A) and the fibers (B) is reduced and the island component is exposed to the surface of the fibers according to some known spinning technologies to thereby partly bond the elastic fibers and the inelastic microfine fibers to each other. Preferably, the mean monofilament fineness of the elastic fibers from the fibers (A) is from 0.01 to 2 dtex, but also including all values, any ranges, sub-ranges in between including 0.2, 0.4, 0.6, 0.8, 1.0, 1.2, 1.4, 1.6, and 1.8 dtex; more preferably from 0.01 to 0.5 dtex, but also including all values, any ranges, or sub-ranges in between including 0.1, 0.2, 0.3, and 0.4 dtex. It is necessary that the mean fiber diameter of the inelastic microfine fibers from the fibers (B) is at most 5 μm, preferably at most 3 μm, more preferably at most 1.5 μm. If the mean fiber diameter is over 5 μm, the flexibility and the dense feel are deteriorated, and, in addition, when napped artificial leather sheet is formed, it gives extremely rough appearance as a whole and is poor in the high-quality feeling such as a natural artificial leather smoothness and good feel. Though not specifically defined, the lowermost limit of the mean fiber diameter of the fibers (B) is preferably at least 0.01 μm in view of the colorability and the physical properties of the artificial leather sheet.

The fibers (B) are converted into microfine fibers of inelastic polymer, or into their fiber bundles.

The porous layer integrated with the entangled nonwoven fabric as referred to herein is meant to indicate that the elastic polymer to form the porous layer and the inelastic polymer exist at random and are integrated together. The porous layer may be confirmed as follows: The artificial leather sheet is processed to remove the microfine fibers of inelastic polymer through extraction or decomposition. After the treatment, the artificial leather sheet is sliced in the direction of the thickness thereof, and the sliced state of the sheet is observed with a scanning electron microscope to confirm the presence of the porous layer. The structural morphology of the elastic polymer can be observed with using the artificial leather sheet as it is, preferably, the inelastic polymer is removed from the sheet by a method where the elastic polymer in the sheet is not swollen, dissolved, and the elastic polymer can be observed easier and more clearly. When the inelastic polymer is nylon, then it may be removed through treatment with a phenolic solvent.

The partial porous condition of the elastic fibers, the partial bonding of the elastic fibers, and the porous layer integrated with the entangled nonwoven fabric are further described with reference to the drawings attached hereto.

FIG. 1 is a scanning electron micrograph showing a cross section of an artificial leather sheet of the invention from which only the inelastic microfine fibers have been removed, represented herein in place of a drawing thereof. Specifically, FIG. 1 shows one example of a cross-section profile of the artificial leather sheet of the invention from which only the microfine fibers of inelastic polymer have been removed. As in FIG. 1, the fibers of elastic polymer are partly porous in at least the surface layer part of the sheet, and the elastic polymer fibers partly bond to each other to form a porous layer integrated with the entangled nonwoven structure of the sheet in the surface layer part thereof.

FIG. 2 is an electronic micrograph showing one example of a cross-section profile of the artificial leather sheet of the invention, represented herein in place of a drawing thereof. FIG. 1 and FIG. 2 confirm that, in the artificial leather sheet of the invention, the elastic polymer fibers are porous at least in the surface layer part of the entangled nonwoven fabric, and a part of the elastic polymer forms a porous layer integrated with the entangled nonwoven fabric structure in at least one surface layer part of the sheet.

The artificial leather sheet produced by specifically processing the entangled nonwoven fabric to give microfine fibers may be, if desired, sliced into two or more pieces in the direction parallel to the main surface of the sheet. The artificial leather sheet may be napped on at least one surface thereof, preferably on the surface of the porous layer thereof to thereby make it have a napped face comprising microfine fibers. Thus processed, it may be a napped artificial leather sheet. The napped face may be formed in any known method of buffing with sand paper or the like. Before the napping treatment, a good solvent for elastic polymer or a solvent or solution comprising a combination of a good solvent and a poor solvent or a known binder resin may be applied to the surface of the sheet in methods of gravure treatment, spray treatment or coater treatment, or the sheet may be heat-pressed to fix the elastic fibers existing in its surface. This facilitates napping of essentially inelastic microfine fibers on the surface of the sheet. The pretreatment before the napping treatment is preferred in the invention, since the thus-processed sheet may have better writing properties and better surface touch.

Thus produced, the napped artificial leather sheet comprises microfine fibers of an inelastic polymer having a mean fiber diameter of at most 5 μm and an elastic polymer, as so mentioned hereinabove, in which the major portion of the elastic polymer forms a fibrous structure of entangled nonwoven fabric with the microfine fibers of inelastic polymer throughout the entire layer of the sheet in the thickness direction thereof, and a part of the elastic polymer forms a porous layer integrated with the entangled nonwoven fabric structure on the surface of the artificial leather sheet. Therefore, the napped artificial leather sheet has good elastic stretchability, good feel and good drapability which conventional artificial leather sheets could not have, and its surface touch, writing effect and outward appearance are all excellent.

When one face of the artificial leather sheet of the invention, preferably the surface of the porous layer thereof is coated with a coating layer, then a grained artificial leather sheet can be produced. The thickness of the coating layer is preferably thin, falling from 10 to 100 μm, but also including all values, any ranges, or sub-ranges in between including 20, 30, 40, 50, 60, 70, 80, and 90 μm; so that the layer does not detract from the elastic stretchability, the drapability and the feel of the sheet. Since the surface layer of the artificial leather sheet of the invention is a porous layer of elastic polymer, the grained artificial leather sheet could still have good surface smoothness even though the coating layer is thin, and, in addition, the peeling strength of the coating layer is high.

The artificial leather sheet of the invention has many applications for clothing, furniture, shoes, bags, etc. In particular, the artificial leather sheet of the invention is especially useful in the field of high-quality grained articles and high-quality suede articles.

Having generally described this invention, a further understanding can be obtained by reference to certain specific examples which are provided herein for purposes of illustration only and are not intended to be limiting unless otherwise specified.

Unless otherwise specifically indicated, "part" and "%" in the following Examples are all by mass. The mean fiber diameter and the physical properties of the samples are determined according to the methods mentioned below.

(1) Mean Fiber Diameter:

The surface or the cross section of the artificial leather sheet was observed with an electron microscope at a magnification of from 500 to 2000 times or so, and the fiber diameter was actually measured. From the data, the mean fiber diameter and the mean filament fineness (dtex) were derived. When the fiber cross-section was not circular, it was estimated by converting the cross-sectional fiber image into a true circle; wherein the diameter of the true circle was taken as the fiber cross-section diameter.

(2) Napping Appearance, Napping Uniformity, Color Mottles, Feel:

The dyed napped artificial leather sheets obtained in the following Examples and Comparative Examples were visually or tactually evaluated by 10 panelists who participate in commercial production and distribution of artificial leathers. The panelists evaluated the artificial leather sheets in terms of: (1) the napping appearance of the napped face of the sheets, (2) the napping uniformity thereof, (3) the color mottles seen in the sheets, and (4) the feel of the sheets including the touch, the softness and the dense feel thereof. The evaluation of the artificial sheets was performed relative to high-quality natural suede articles having smooth and uniform appearance, the sheets were grouped into three ranks, A, B and C, and from the results, the sheets were totally evaluated. "A" means that the appearance, the touch and the feel of the sheet were all on the level of the intended natural suede articles; "B" means that the sheet was somewhat inferior to natural leather suede, but had no practical problem; and "C" means that the sheet was inferior to natural leather suede and did not have a commercial value.

EXAMPLES

Example 1 (E-1)

Poly-3-methyl-1,5-pentane adipate glycol having a mean molecular weight of 2000, 4,4'-diphenylmethane diisocyanate, polyethylene glycol and 1,4-butanediol were melt-polymerized so that the nitrogen content attributable to the isocyanate group was about 4.3% to produce a polyester polyurethane having a melt viscosity of about 5000 poises. In a screw extruder, 50 parts of the polyester polyurethane pellets, having been dried to a water content of at most about 50 ppm (island elastic polymer), and 50 parts of low-density polyethylene pellets (sea component) were melt-kneaded, and then melt-spun out at 230° C. to give sea-island mix-spun fibers ($A_0$) having a fineness of 14 dtex and having polyurethane partly exposed to the surface thereof. Separately, 50 parts of nylon-6 pellets (island inelastic polymer) and 50 parts of polyethylene pellets (sea component) were melt-kneaded in a screw extruder and then melt-spun out at 280° C. to give sea-island mix-spun fibers ($B_0$) having a fineness of 10 dtex. The fibers $A_0$ and the fibers $B_0$ were mixed so that the ratio by mass of the polyester polyurethane fibers to the nylon fibers after the microfine fibers-forming treatment was about 40/60, drawn 2.5-fold, crimpled and cut to give staple fibers of a mixture of 7-dtex fibers ($A_1$) and 4-dtex fibers ($B_1$) having a fiber length of 51 mm.

The mixed fibers were carded, formed into a web by the use of a crosslap webber, and needle-punched with single barb needles in a density of 1500 punches/cm$^2$ to give an entangled nonwoven fabric (I) having a mass per unit area of 800 g/m$^2$. The entangled nonwoven fabric (I) was shrunk in hot water (95° C.) by about 30% in areal ratio to give an entangled nonwoven fabric (II). Then, the entangled nonwoven fabric (II) was dipped in an aqueous polyurethane emulsion composition having a polyether polyurethane solid concentration of about 2% (whereupon the amount of polyurethane added to the entangled nonwoven fabric (II) was about 1%), and then heated. Thus processed, the entangled nonwoven fabric (II) was heated while dried in a drier, whereby the sea component, polyethylene was softened and the fibers were partly bonded to each other to give a shape-sustaining, entangled nonwoven fabric (III) having a thickness of 2.63 mm, a mass per unit area of 1040 g/m$^2$, and a density of 0.395 g/cm$^3$.

Next, a 4% solution of polycarbonate polyurethane in DMF solvent was applied to both surfaces of the entangled nonwoven fabric (III) in an amount of 250 g/m$^2$ on each surface by the use of a roll coater, then put into an aqueous 30% solution of DMF at 40° C., and washed with water to thereby replace DMF remaining in the entangled nonwoven fabric with water. This was processed in a hot toluene bath at 90° C. to dissolve and remove polyethylene from the fibers ($A_1$) and the fibers ($B_1$) (treatment for forming microfine fibers), then processed in hot water at 90 to 100° C. to thereby substitute toluene existing in the entangled nonwoven fabric with water through azeotropy with water, and dried while set in a predetermined width to give an artificial leather sheet (I) having a thickness of about 1.3 mm.

In the artificial leather sheet (I) thus obtained, the mean fiber diameter of microfine fibers of nylon was about 1.1 μm. Electron-microscopic observation of the surface and the cross section of the sheet (I) revealed the following: The polyurethane fibers were partly porous and were partly bonded to each other, and they formed an entangled nonwoven fabric structure with the microfine fibers of nylon throughout the entire layer of the artificial leather sheet. In both the surface and the back of the artificial leather sheet, polyurethane partly formed a porous layer integrated with the entangled nonwoven fabric structure. Further, it was observed that the polyurethane fibers partly bonded to the nylon microfine fibers in places in the entire layer of the artificial leather sheet, and especially intensively in the surface layer part thereof.

The artificial leather sheet (I) was sliced, into two parts, at the center in the direction of the thickness, and the sliced face was polished by the use of a buffing machine with #180-grit sandpaper. Thus polished, the sliced sheet had a thickness of 0.50 mm. Next, the opposite side of the sheet to the sliced face (that is, the surface side before the slicing) was napped by the use of a buffing machine with #400-grit sandpaper to give an undyed napped artificial leather sheet. The napped artificial leather sheet was dyed brown according to the condition mentioned below, then crumpled and brushed with a brush roll.

| | |
|---|---|
| Dyeing machine: | Wince, |
| Dyes: | Irgalan Brown 2RL (from Ciba Specialty Chemicals), owf 4%, Irgalan Yellow 2GL (from Ciba Specialty Chemicals), owf 1%, |
| Leveling agent: | Levelan NK-D (from Marubishi Oil Chemicals) 2 g/liter, |
| Liquor ratio: | 1/20, |
| Temperature and time for dyeing: | 60 min at 90° C. |

The brown-dyed napped artificial leather sheet was crumpled and brushed with a brush roll. This was stretchable in the cross-direction and was well-drapable. The elastic stretchability of the thus-obtained napped artificial leather sheet was excellent, even after repeated (10 times) elongation (30%), it did not undergo structural change. In addition, this still kept a soft and dense feel and had good drapability. The other test results of the sheet are shown in Table 1.

Example 2 (E-2)

A 20% solution of polycarbonate polyurethane in DMF solvent was applied to both surfaces of the entangled nonwoven fabric (III) fabricated in Example 1, in an amount of 500 g/m$^2$ on each surface by the use of a roll coater to form a grain layer thereon, then put into an aqueous 30% solution of DMF at 40° C., and washed with water to thereby replace DMF remaining in the entangled nonwoven fabric with water. This was processed in a hot toluene bath at 90° C. to dissolve and remove polyethylene from the fibers ($A_1$) and the fibers ($B_1$), then processed in hot water at 90 to 100° C. to thereby substitute toluene existing in the entangled nonwoven fabric with water through azeotropy with water, and dried while set in a predetermined width to give a grained artificial leather sheet having a thickness of about 1.3 mm.

In the grained artificial leather sheet thus obtained, the mean fiber diameter of microfine fibers of nylon was about 1.1 μm. Electron-microscopic observation of the surface and the cross section of the sheet revealed the following: The sheet was coated with a grain layer of foamed polyurethane. The polyurethane fibers in the entangled nonwoven fabric below the grain layer were partly porous and were partly bonded to each other, and they formed an entangled nonwoven fabric structure with the microfine fibers of nylon throughout the entire layer of the entangled nonwoven fabric part of the artificial leather sheet. Below the grain layer of the sheet, polyurethane partly formed a porous layer integrated with the entangled nonwoven fabric structure. Further, it was observed that the polyurethane fibers partly bonded to the nylon microfine fibers throughout the entire layer of the entangled nonwoven fabric of the artificial leather sheet, and especially intensively below the grain layer and in the back layer part opposite to the grain layer of the entangled nonwoven fabric. The test results of the sheet are given in Table 2.

Example 3 (E-3)

An embossed release paper (Lintec's TP R-8) was coated with a polyurethane resin solution comprising 100 parts of silicone-modified polyether polyurethane (Dainippon Ink Chemical Industry's NY214, 100%-modulus 40%, solid content 20%), 20 parts of black pigment (Dainippon Ink Chemical Industry's Dailac L6910N), 30 parts of DMF and 30 parts of methyl ethyl ketone to form a coating layer thereon, so that the mean thickness of the dried layer was about 40 microns, and then heated at 100° C. for 5 minutes to form thereon the intended coating layer. This was further coated with a two-pack curable polyether polyurethane solution so that the mean thickness of the dried adhesive layer was about 30 microns, and dried at 50° C. for 3 minutes. On the other hand, the artificial leather sheet (I) fabricated in Example 1 was sliced, into two parts, at the center in the direction of the thickness, and the sliced face was polished by the use of a buffing machine with #180-grit sandpaper, and the thus-polished sliced sheet had a thickness of 0.50 mm. This was attached to the release film as above while the coating layer on the film was still sticky, then this was dried at 100° C. for 2 minutes, and thereafter left at 40° C. for 3 days. Then, the release film was peeled off. Thus processed, the sheet was then dipped in an aqueous 5% solution of a softener (Nicca Chemical's Co., LTD Nicca Silicone AM-204, solid content 20%) so as to have an impregnation ratio of 50% to further soften the sheet. This was dried in a tumbler drier at 70° C. for 40 minutes. Thus fabricated, the grained artificial leather sheet had a soft feel and had good elastic stretchability and drapability. In addition, though the coating layer was extremely thin, its surface smoothness was good, and its peeling strength was high. The other test results of the sheet are shown in Table 2.

Comparative Example 1 (CE-1)

The entangled nonwoven fabric (III) fabricated in Example 1 was dipped in a 4% solution of polycarbonate polyurethane dissolved in DMF solvent, then put into an aqueous 30% solution of DMF at 40° C., and washed with water to thereby replace DMF remaining in the entangled nonwoven fabric with water. This was processed in a hot toluene bath at 90° C. in order to dissolve and remove polyethylene from the fibers ($A_1$) and the fibers ($B_1$), then processed in hot water at 90 to 100° C. to thereby substitute toluene existing in the entangled nonwoven fabric with water through azeotropy with water, and dried while set in a predetermined width to give an artificial leather sheet having a thickness of about 1.3 mm.

In the artificial leather sheet thus obtained, the mean fiber diameter of microfine fibers of nylon was about 1.1 μm. Electron-microscopic observation of the surface and the cross section of the sheet revealed the following: The polyurethane fibers were partly porous throughout the entire layer of the artificial leather sheet, and they formed an entangled nonwoven fabric structure with the microfine fibers of nylon throughout the entire layer of sheet while partly bonded to each other to form a network structure. In addition, it was observed that the polyurethane fibers partly bonded to the nylon microfine fibers in places throughout the entire layer of the sheet.

The artificial leather sheet obtained herein was split, polished, napped, dyed, crimpled and brushed in the same manner as in Example 1 to give a napped artificial leather sheet. As compared with that of Example 1, the napped artificial leather sheet was inferior in the smoothness and its elastic stretchability and drapability did not reach the level of Example 1. The other test results of the sheet are shown in Table 1.

Comparative Example 2 (CE-2)

An artificial leather sheet having a thickness of about 1.3 mm was fabricated in the same manner as in Example 1, except that the entangled nonwoven fabric (III) was not processed with a 4% solution of polycarbonate polyurethane in DMF solvent through dipping therein, solidification and washing with water. Electron-microscopic observation of the surface and the cross section of the sheet revealed the following: The elastic polymer fibers had no pores, and they did not bond to each other. Further, they did not form a network structure.

The artificial leather sheet was sliced, into two parts, in the direction of the thickness, and the sliced face was polished by the use of a buffing machine to give a polished artificial leather sheet having a thickness of 0.52 mm. The opposite side of the sheet to the sliced face was napped by the use of a buffing machine with #400-grit sandpaper to give an undyed napped artificial leather sheet. The condition of the nap of the napped artificial leather sheet was unstable, and the process-passing properties thereof were not good.

This was dyed under the same condition as in Example 1. Thus obtained, the brown-dyed, velour napped artificial leather sheet had a poor and uneven fluff feel and its appearance was not good. This had good drapability and elastic stretchability. However, after repeated 30% elongation, its shape sustainability was inferior to that of Example 1. Though soft, the sheet did not have a dense feel. The test results of the sheet are given in Table 1.

Comparative Example 3 (CE-3)

The 4-dtex staple fibers (B1) alone were carded, formed into a web by the use of a crosslap webber, and needle-punched with single barb needles in a density of 1500 punches/cm$^2$ to give an entangled nonwoven fabric having a mass per unit area of 800 g/m$^2$. The entangled nonwoven fabric was heated in a drier, whereby the sea component, polyethylene was softened and the fibers were partly bonded to each other to give an entangled nonwoven fabric (III) having a thickness of 2.65 mm, a mass per unit area of 850 g/m$^2$, and a density of 0.32 g/cm$^3$. A 13% DMF solution of polyether polyurethane was infiltrated into the entangled nonwoven fabric, and then this was put into an aqueous 30% solution of DMF at 40° C., and washed with water to thereby replace DMF remaining in the entangled nonwoven fabric with water. This was processed in a hot toluene bath at 90° C. to dissolve and remove polyethylene from the fibers ($B_1$), then processed in hot water at 90 to 100° C. to thereby substitute toluene existing in the entangled nonwoven fabric with water through azeotropy with water, and dried while set in a predetermined width to give an artificial leather sheet having a thickness of 1.3 mm, in which non-fibrous polyurethane formed a porous structure in the space of the entangled nonwoven fabric of nylon-6 microfine fibers. The nylon-6 microfine fibers were dissolved and removed from the artificial leather sheet, and a foamed sheet of polyurethane was obtained. In the artificial leather sheet obtained herein, the mean fiber diameter of the nylon-6 microfine fibers was about 1.1 μm. Electron-microscopic observation of the surface and the cross section of the sheet revealed that the sheet had no fibrous polyurethane therein, as so mentioned above.

The artificial leather sheet was sliced, polished, napped, dyed, crimpled and brushed in the same manner as in Example 1 to give a napped artificial leather sheet. Its elastic stretchability and drapability were not good. The test results of the sheet are given in Table 1.

TABLE 1

| Examples | T[a] mm | MPUA[b] g/m$^2$ | D[c] g/cm$^3$ | NA[d] | NU[e] | CM[f] | F[g] | TE[h] |
|---|---|---|---|---|---|---|---|---|
| E-1 | 0.50 | 218 | 0.44 | A | A | A | A | A |
| CE-1 | 0.50 | 230 | 0.46 | A | A | A | C | B |
| CE-2 | 0.50 | 213 | 0.43 | C | C | C | A | C |
| CE-3 | 0.50 | 190 | 0.38 | A | A | B | C | C |

[a]T, Thickness.
[b]MPUA, Mass per unit area.
[c]D, Density.
[d]NA, Napping Apearance.
[e]NU, Nap Uniformity.
[f]CM, Color Mottles.
[g]F, Feel.
[h]TE, Total Evaluation Comparative Example 4 (CE-4)

The artificial leather sheet fabricated in Comparative Example 2 was face-finished in dry in the same manner as in Example 3. The artificial leather sheet obtained herein was inferior to that of Example 3 in point of the integrality and the surface smoothness. Its test results are given in Table 2.

TABLE 2

| Examples | T[a] mm | MPUA[b] g/m$^2$ | D[c] g/cm$^3$ | I[d] | SS[e] | Feel[f] |
|---|---|---|---|---|---|---|
| E-2 | 1.3 | 540 | 0.42 | A | A | A |
| CE-3 | 1.3 | 520 | 0.40 | A | A | A |
| CE-4 | 1.3 | 450 | 0.35 | C | C | B |

[a]T, Thickness.
[b]MPUA, Mass per unit area.
[c]D, Density.
[e]I, Integrality.
[d]SS, Surface Smoothness.
[f]F, Feel.

As described hereinabove with reference to its preferred embodiments, the artificial leather sheet of the invention does not substantially undergo structure deformation even when repeatedly elongated and deformed, or in other words, the sheet has good elastic stretchability and fiber entanglement and has a soft and dense feel. When at least one face of the sheet is napped, it gives a napped artificial leather sheet having a good napping appearance, a good feel and good elastic stretchability and drapability. When at least one face of the sheet is coated with a coating layer of essentially an elastic polymer, the sheet may be a substrate of grained artificial leather sheets. The grained artificial leather sheet of the invention has a good feel and has good elastic stretchability and drapability. In addition, even though the coating layer is thin, its surface smoothness is good and its peeling strength is high. The artificial leather sheet of the invention has many applications for clothing, furniture, shoes, bags, etc.

Obviously, numerous modifications and variations on the present invention are possible in light of the above teachings. It is therefore to be understood that within the scope of the appended claims, the invention may be practiced otherwise than as specifically described herein.

This application is based on Japanese Patent Application No. 2003-304531, filed in the Japanese Patent Office on Aug. 28, 2003, the entire contents of which are hereby incorporated by reference.

What is claimed as new and desired to be secured by Letters Patent of the United States:

1. A process for producing artificial leather sheets, which comprises an entangled non-woven fabric base structure and a porous region in at least one face of the entangled nonwoven fabric base structure, wherein said entangled non-woven base structure comprises elastic polymer fibers and inelastic polymer microfine fibers, wherein the process comprises sequentially:

preparing an entangled nonwoven fabric that comprises fibers (A) wherein 0.1 to 95% of an areal proportion of the surface of the fibers is occupied by the elastic polymer and capable of forming fibers of an elastic polymer and fibers (B) capable of forming microfine fibers of an inelastic polymer having a mean fiber diameter of at most 5 μm, applying a liquid that contains at least a good solvent for the elastic polymer, to at least one face of the entangled nonwoven fabric to thereby partly dissolve the elastic polymer in the fibers (A) existing in at least the surface layer part thereof, and then applying thereto a poor solvent for the elastic polymer, and forming fibers of elastic polymer and microfine fibers of inelastic polymer having a mean fiber diameter of at most 5 μm, from the fibers (A) and the fibers (B), respectively.

2. A process for producing artificial leather sheets as claimed in claim 1, wherein the microfine fibers of an inelastic polymer have a mean fiber diameter of at most 3 μm.

3. A process for producing artificial leather sheets as claimed in claim 1, wherein the inelastic polymer is selected from the group consisting of a melt-spinnable polyamide, a melt-spinnable polyester, a melt-spinnable polyolefin, and combinations thereof.

4. A process for producing artificial leather sheets as claimed in claim 1, wherein the elastic polymer is selected from the group consisting of a polyurethane, a polyester elastomer, a polyamide elastomer, a conjugated diene polymer; and combinations thereof.

5. A process for producing artificial leather sheets as claimed in claim 1, wherein the elastic polymer is at least one polyurethane.

6. A process for producing artificial leather sheets as claimed in claim 1, wherein the elastic polymer is at least one polyurethane prepared from a process which comprises reacting at least one polyol, a polyisocyanate, and a chain extender having two active hydrogen atoms.

7. An artificial leather sheet, comprising an entangled nonwoven fabric base structure and a porous region in at least one face of the entangled nonwoven fabric base structure, wherein said entangled non-woven base structure comprises elastic polymer fibers and inelastic polymer microfine fibers, wherein the artificial leather sheet is prepared by sequentially:

preparing an entangled nonwoven fabric that comprises fibers (A) wherein 0.1 to 95% of an areal proportion of the surface of the fibers is occupied by the elastic polymer and capable of forming fibers of an elastic polymer and fibers (B) capable of forming microfine fibers of an inelastic polymer having a mean fiber diameter of at most 5 μm, applying a liquid that contains at least a good solvent for the elastic polymer, to at least one face of the entangled nonwoven fabric to thereby partly dissolve the elastic polymer in the fibers (A) existing in at least the surface layer part thereof, and then applying thereto a poor solvent for the elastic polymer, and forming fibers of elastic polymer and microfine fibers of inelastic polymer having a mean fiber diameter of at most 5 μm, from the fibers (A) and the fibers (B), respectively.

8. The artificial leather sheet as claimed in claim 7, wherein the elastic polymer fibers form a partly porous structure.

9. The artificial leather sheet as claimed in claim 7, wherein the microfine fibers of inelastic polymer and the elastic polymer fibers are partly bonded to each other.

10. The artificial leather sheet as claimed in claim 7, wherein the microfine fibers of inelastic polymer have a mean fiber diameter of at most 3 μm.

11. The artificial leather sheet as claimed in claim 7, wherein the inelastic polymer is selected from the group consisting of a melt-spinnable polyamide, a melt-spinnable polyester, a melt-spinnable polyolefin and combinations thereof.

12. The artificial leather sheet as claimed in claim 7, wherein the elastic polymer is selected from the group consisting of a polyurethane, a polyester elastomer, a polyamide elastomer, a conjugated diene polymer and combinations thereof.

13. The artificial leather sheet as claimed in claim 7, wherein the elastic polymer is at least one polyurethane.

14. The artificial leather sheet as claimed in claim 7, wherein the elastic polymer is at least one polyurethane prepared by a process which comprises reacting at least one polyol, a polyisocyanate, and a chain extender having two active hydrogen atoms.

15. The artificial leather sheet as claimed in claim 7, wherein the thickness of said sheet ranges from 0.2 to 10 mm.

16. The artificial leather sheet as claimed in claim 7, wherein the fabric of said sheet has a density of 0.20 to 0.65 $g/cm^3$.

17. The artificial leather sheet as claimed in claim 16, wherein said density ranges from 0.25 to 0.55 $g/cm^3$.

18. The artificial leather sheet as claimed in claim 7, wherein the inelastic polymer content of the fibers (B) in the fabric of the sheet ranges from 10 to 90% by wt of the fiber mass.

19. A napped artificial leather sheet that comprises a nap comprising microfine fibers of an inelastic polymer, on at least the face of the artificial leather sheet of claim 7 having a porous region.

20. A grained artificial leather sheet that has a coating layer on at least the face of the artificial leather sheet of claim 7 having a porous region.

* * * * *